US008079822B2

(12) United States Patent
Kitsunai et al.

(10) Patent No.: US 8,079,822 B2
(45) Date of Patent: Dec. 20, 2011

(54) PROPELLER FOR WATERCRAFT AND OUTBOARD MOTOR

(75) Inventors: Toru Kitsunai, Shizuoka (JP); Yukihiro Kurimoto, Shizuoka (JP)

(73) Assignee: Yamaha Hatsudoki Kabushiki Kaisha, Shizuoka (JP)

( * ) Notice: Subject to any disclaimer, the term of this patent is extended or adjusted under 35 U.S.C. 154(b) by 1130 days.

(21) Appl. No.: 11/840,253

(22) Filed: Aug. 17, 2007

(65) Prior Publication Data

US 2008/0050989 A1 Feb. 28, 2008

(30) Foreign Application Priority Data

Aug. 23, 2006 (JP) ..... 2006-226351

(51) Int. Cl.
*F01D 5/14* (2006.01)

(52) U.S. Cl. ..... 416/241 R; 416/244 B

(58) Field of Classification Search ..... 416/244 B, 416/241 R, 241 A
See application file for complete search history.

(56) References Cited

U.S. PATENT DOCUMENTS 4,692,123 A 9/1987 Tada et al.
4,847,048 A * 7/1989 Nishi et al. ..... 420/547
2005/0100473 A1 5/2005 Ikuno et al.
2005/0163647 A1 7/2005 Donahue et al.

FOREIGN PATENT DOCUMENTS

JP 48095946 A * 12/1973
JP 3029215 U 9/1996
JP 2005-139552 A 6/2005
JP 2006-207024 A 8/2006

OTHER PUBLICATIONS

Toru Kitsunai et al.; "Propeller for Watercraft and Outboard Motor"; U.S. Appl. No. 11/840,254, filed Aug. 17, 2007.

* cited by examiner

*Primary Examiner* — Edward Look
*Assistant Examiner* — Dwayne J White
(74) *Attorney, Agent, or Firm* — Keating & Bennett, LLP

(57) ABSTRACT

A propeller for watercraft having excellent abrasion resistance and deformation resistance includes a propeller body having a blade and a hub portion, the propeller body being composed of an aluminum alloy and having a Vickers hardness of no less than about 60 Hv and no more than about 95 Hv; and an anodic oxide coating of the aluminum alloy provided so as to cover a surface of the propeller body. The anodic oxide coating has a thickness of no less than about 20 μm and no more than about 100 μm. Preferably, the anodic oxide coating has a hardness of no less than about 300 Hv and no more than about 450 Hv.

7 Claims, 4 Drawing Sheets

PROPELLER FOR WATERCRAFT AND OUTBOARD MOTOR

BACKGROUND OF THE INVENTION

1. Field of the Invention

The present invention relates to a propeller for watercraft and an outboard motor.

2. Description of the Related Art

An outboard motor can be attached to a boat body by being simply engaged onto the stern of a boat, and does not occupy any space inside the boat. Therefore, outboard motors are widely used for small-sized boats, e.g., pleasure boats and small fishing boats. In accordance with the boat body sizes and purposes, outboard motors of various output powers are in use today.

Generally speaking, an outboard motor having a propeller made of stainless steel and an engine with high output power (e.g., 100 horsepower or more) is used for a relatively large boat. On the other hand, for a relatively small boat, an outboard motor having a propeller of aluminum or the like and an engine with relatively low output power is used. An aluminum propeller is light-weight and can be produced at low cost. Therefore, as a propeller of an outboard motor for a small boat, an aluminum propeller satisfies the demands in terms of function and cost.

In the case of forming such a watercraft propeller from aluminum, it is necessary to prevent corrosion of the aluminum caused by seawater. Therefore, generally speaking, propellers having its aluminum propeller body coated or painted with a corrosion resistance or preventative material are widely used.

Japanese Utility Model No. 3029215 discloses, in order to prevent deteriorations in water dissipation during the rotation of a propeller (which may happen when the propeller edge is made dull by any painted film that is provided on the propeller surface), subjecting an aluminum propeller to a hard anodized aluminum treatment to secure a sharp propeller edge.

Conventional aluminum propellers for outboard motors have the following problems.

Specifically, small-sized boats are often used at inshore locations and on rivers, for purposes such as fishery, business operations, and leisure activities. In such places, objects such as driftwood and hard nuts may be floating near the surface of the water. Such floating objects may possibly collide with the propeller of an outboard motor. When traveling on a river, contact with plants or trees growing on the river shore or the river bed may also be possible. If collision against such floating objects or contact with plants or trees occurs, the propeller may be deformed, whereby the propulsion power of the propeller may be considerably lowered.

Moreover, a small-sized boat having an outboard motor may be pulled onto a sand beach for mooring, or may be moored in the shallow area by a river shore. Therefore, when mooring a boat, or when going out onto the river or the sea from a point of mooring, sand may be stirred up, and the propeller surface may be abraded as the propeller is rotated in the sand-containing water. If the paint on the propeller surface peels due to such abrasion, the propeller body may be corroded, and further the propeller body may be abraded.

Such problems have occurred with respect not only to boats having outboard motors, but also to small-sized boats having an engine installed inside the boat.

Japanese Utility Model No. 3029215 merely discloses forming an anodized aluminum layer (which is known as a corrosion-protective coating for aluminum), instead of a painted film for corrosion protection, without teaching or suggesting the aforementioned problems. Moreover, in order not to allow the propeller edge to become dull, it would be impossible to form a thick layer of hard anodized aluminum. Therefore, the thickness of the hard anodized aluminum layer for a propeller according to Japanese Utility Model No. 3029215 can only be about 15 μm, which is not considered to provide sufficient abrasion resistance and deformation resistance.

SUMMARY OF THE INVENTION

In order to overcome the aforementioned problems of conventional techniques, preferred embodiments of the present invention provide a propeller for watercraft and an outboard motor having excellent abrasion resistance and deformation resistance.

A propeller for watercraft according to a preferred embodiment of the present invention includes: a propeller body having a blade and a hub portion, the propeller body being composed of an aluminum alloy and having a Vickers hardness of no less than about 60 Hv and no more than about 95 Hv; and an anodic oxide coating of the aluminum alloy provided so as to cover a surface of the propeller body, wherein, the anodic oxide coating has a thickness of no less than about 20 μm and no more than about 100 μm.

In a preferred embodiment, the anodic oxide coating preferably has a hardness of no less than about 300 Hv and no more than about 450 Hv.

In a preferred embodiment, the propeller body is molded by a die casting technique using the aluminum alloy.

In a preferred embodiment, the aluminum alloy is an Al—Mg alloy containing about 1.5 wt % or less of silicon.

In a preferred embodiment, the Al—Mg alloy further contains no less than about 0.5 wt % and no more than about 1.8 wt % of at least one of iron and manganese.

In a preferred embodiment, the aluminum alloy is an Al—Si alloy having been subjected to an annealing treatment.

An outboard motor according to a preferred embodiment of the present invention includes any of the aforementioned propellers for watercraft.

A boat according to a preferred embodiment of the present invention includes the aforementioned outboard motor.

A method of producing a propeller for watercraft according to another preferred embodiment of the present invention includes: a step of molding a propeller body having a blade and a hub portion and having a Vickers hardness of no less than about 60 Hv and no more than about 95 Hv by die casting technique using an aluminum alloy; and a step of subjecting the propeller body to an anodic oxidation to form an anodic oxide coating having a thickness of no less than about 20 μm and no more than about 100 μm on a surface of the propeller body.

In a preferred embodiment, a concentration and a temperature of an electrolytic bath used for the anodic oxidation are adjusted so that the anodic oxide coating has a hardness of no less than about 300 Hv and no more than about 450 Hv.

In a preferred embodiment, the aluminum alloy is an Al—Mg alloy containing about 1.5 wt % or less of silicon.

In a preferred embodiment, the Al—Mg alloy further contains no less than about 0.5 wt % and no more than about 1.8 wt % of at least one of iron and manganese.

In a preferred embodiment, the aluminum alloy is an Al—Si alloy, and the step of molding the propeller body includes a step of subjecting the propeller body to an annealing treatment after the molding by die casting.

According to various preferred embodiments of the present invention, the propeller surface is covered by an anodic oxide coating having a high hardness, and the propeller body has moderate elastic deformation characteristics. As a result, even in a collision against driftwood or the like, chipping of the blades and plastic deformation are prevented. Excellent abrasion resistance is also provided. Thus, a propeller for watercraft having excellent durability is realized.

Other features, elements, processes, steps, characteristics and advantages of the present invention will become more apparent from the following detailed description of preferred embodiments of the present invention with reference to the attached drawings.

DETAILED DESCRIPTION OF PREFERRED EMBODIMENTS

Hereinafter, preferred embodiments of a propeller for watercraft and an outboard motor according to the present invention will be described.

Figure 1A:
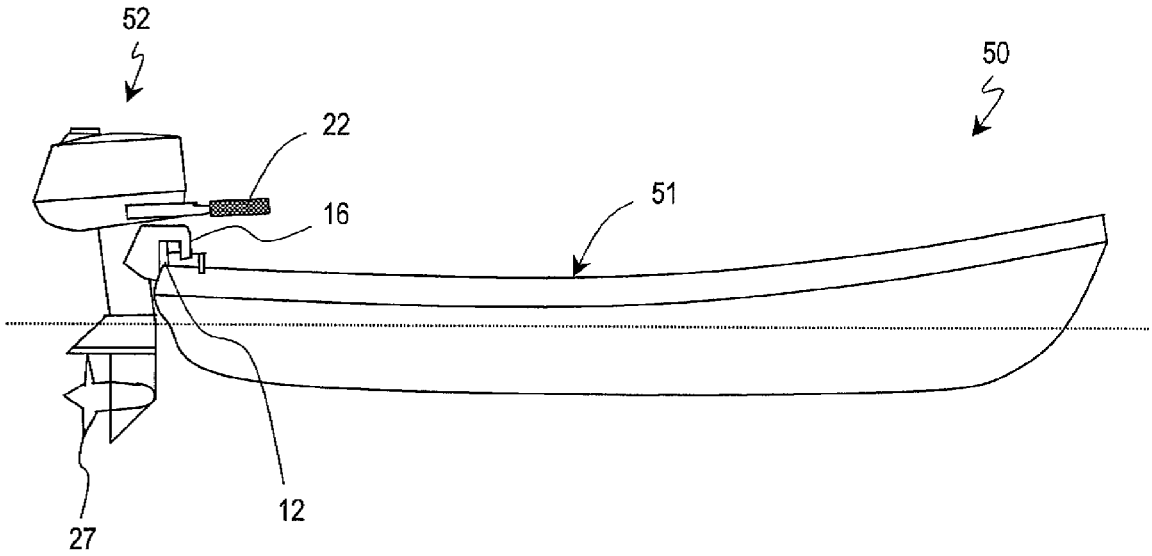
FIG. 1A is a side view of a boat having an outboard motor according to a preferred embodiment of the present invention.

FIG. 1A is a side view of a boat 50 having an outboard motor according to a preferred embodiment of the present invention. The boat 50 includes a boat body 51 and an outboard motor 52. The outboard motor 52 includes a clamp 16, a propeller 27, and a steering handle 22. The outboard motor 52 is attached at a stern 12 of the boat body 51 with a clamp 16. The driver adjusts the orientation of the outboard motor 52 with the steering handle 22, thus being able to change the direction of travel of the boat 50.

Figure 2:
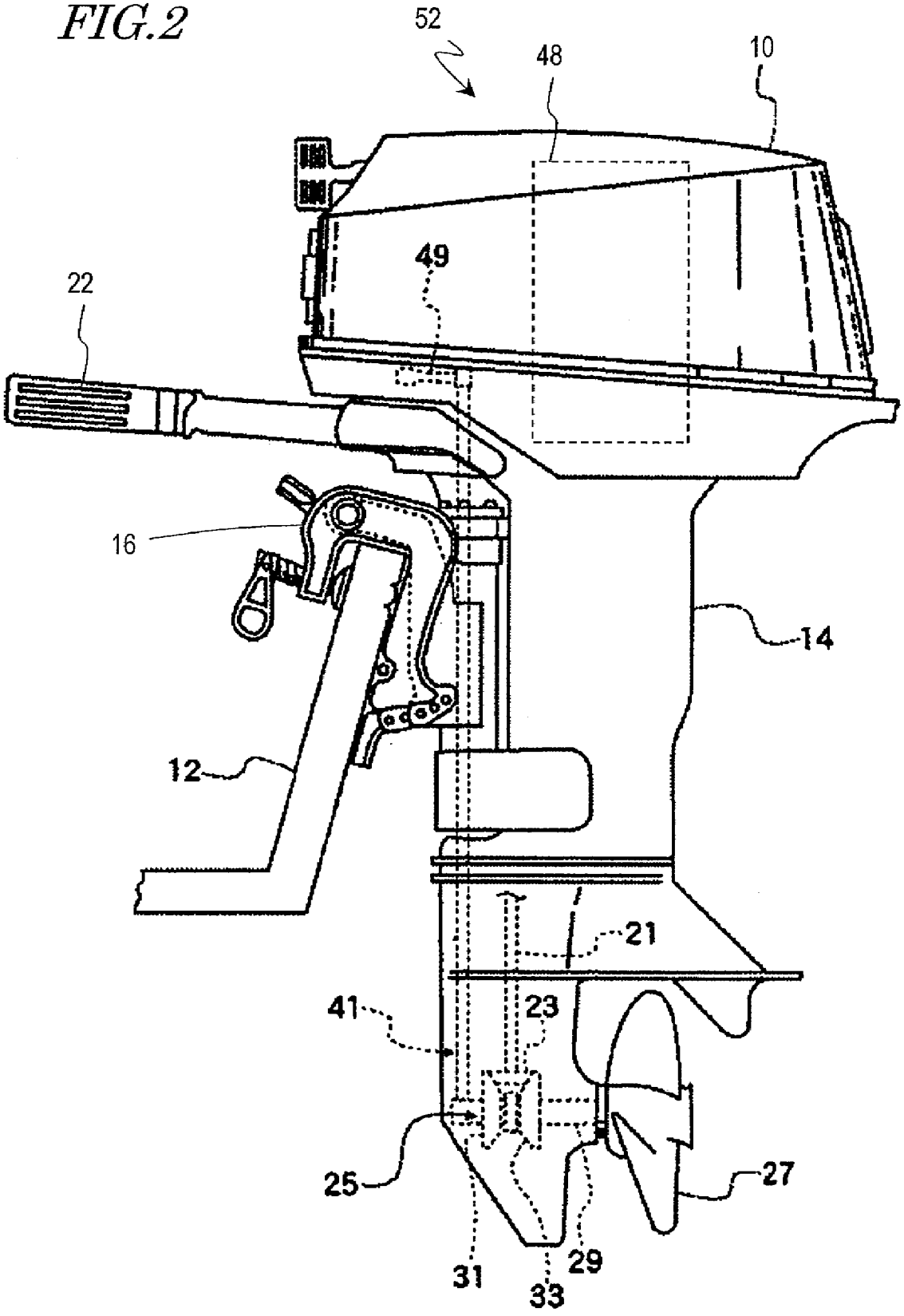
FIG. 2 is a side view showing a preferred embodiment of an outboard motor according to the present invention.

FIG. 2 is a side view of the outboard motor 52. The outboard motor 52 includes an engine 48, such that rotary motive force from the engine 48 is transmitted to a drive shaft 21, to which a driving gear 23 is attached. In order to cause the boat 50 to move forward or backward by changing the direction of rotation of the propeller 27, the outboard motor 52 includes a switching mechanism 41 and a clutch device 25. The clutch device 25 includes a forward gear 31 and a reverse gear 33. By operating a shift lever 49 which is linked to the switching mechanism 41, either the forward gear 31 or the reverse gear 33 is allowed to selectively engage with the driving gear 23. As a result, the propeller 27 which is fixed to the output shaft 29 rotates in the forward direction or reverse direction. The engine 48 and the aforementioned driving mechanism are accommodated inside a casing 14 and a cowling 10.

Figure 1B:
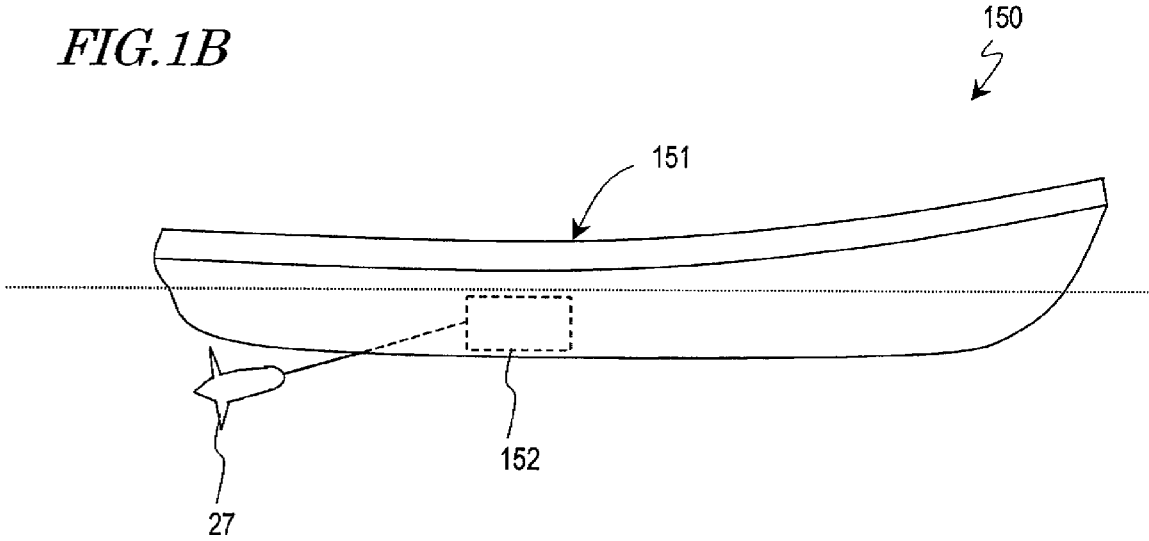
FIG. 1B is a side view showing a boat having a propeller for watercraft according to a preferred embodiment of the present invention.

The propeller for watercraft according to a preferred embodiment of the present invention is suitably used for an outboard motor, but is also suitable for a boat having a so-called "inboard" engine which is mounted within the boat body. FIG. 1B is a side view of a boat 150 having a propeller 27 for watercraft according to the present invention. Within the boat body 151 of the boat 150, an engine 152 is mounted, such that motive force from the engine 152 is transmitted via a shaft to the propeller 27 which is supported at the rear of the bottom so as to be capable of rotating.

Figure 3:
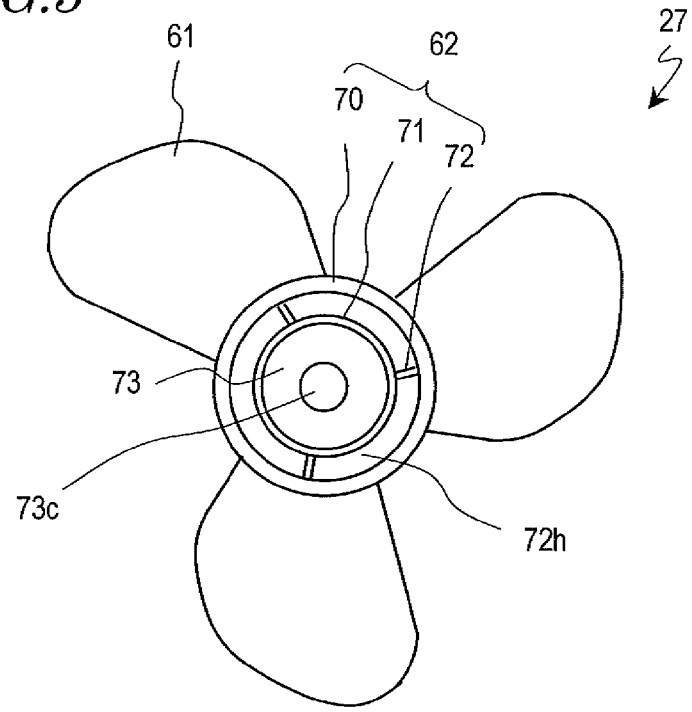
FIG. 3 is a plan view showing a propeller of the outboard motor shown in FIG. 2.

FIG. 3 is a plan view showing the propeller 27. The propeller 27 includes blades 61 and a hub portion 62 to which the blades 61 are connected. In the present preferred embodiment, the hub portion 62 includes an outer hub 70, an inner hub 71, and ribs 72 connecting the outer hub 70 to the inner hub 71. The present preferred embodiment adopts a structure in which the outboard motor 52 allows exhaust gas from the engine 48 to be ejected toward the rear of the propeller 27, through a gap 72*h* between the inner hub 71 and the outer hub 70, hence arriving at the double-structured hub portion. The hub portion 62 may have a single structure in the case where the outboard motor 52 allows exhaust gas to be released at another location. There is no limitation as to the number of blades 61 and their shape. The propeller 27 may have any other shape than that illustrated in FIG. 3.

The inner hub 71 of the hub portion 62 defines a substantially cylindrical internal space, with a bushing 73 being press-fitted into the internal space. The bushing 73 is preferably composed of an elastic body such as rubber, such that the bushing 73 is fixed within the inner hub 71 based on friction between the bushing 73 and the inner hub 71. A hole 73*c* is provided in the center of the bushing 73, and the output shaft 29 of the outboard motor 52 is inserted into the hole 73*c*.

Since the bushing 73 and the inner hub 71 are fixed based on friction, when the propeller 27 collides into driftwood or the like during its rotation, the bushing 73 will slip against the inner hub 71, so that the propeller 27 can come to a stop while allowing the output shaft 29 to rotate. Thus, even when a foreign object collides against the propeller so as to stop the rotation of the propeller 27, the output shaft 29 and the engine 48 are prevented from stopping the rotation, thus preventing the gears from being destroyed by stopping the rotation of the clutch device 25 and the engine 48 and preventing malfunctioning of the engine 48.

Figure 4:
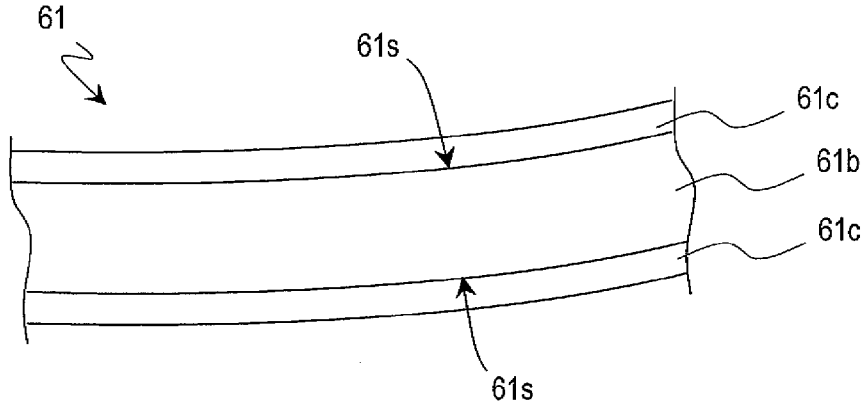
FIG. 4 is a view showing a partial cross section of a blade of the propeller of FIG. 3.

For excellent characteristics in terms of abrasion resistance and deformation resistance, the propeller 27 of the outboard motor 52 according to a preferred embodiment of the present invention is constructed so that the propeller 27 is composed of an aluminum alloy with a predetermined hardness, and the entire surface of the propeller 27 is covered with an anodic oxide coating. FIG. 4 shows a partial cross section of the blade 61 of the propeller 27. The blade 61 includes a blade body 61*b* and an anodic oxide coating 61*c* of an aluminum alloy which is provided on the surface of the blade body 61*b*. Although not shown, the hub portion similarly includes a hub body and an anodic oxide coating which covers the surface of the hub body, such that the blade body 61*b* and the hub body together define a propeller body.

It is preferable for the entire propeller 27 to undergo moderate elastic deformation upon collision against a foreign object such as driftwood, thus absorbing the energy of collision and preventing plastic deformation of the entire propeller. Therefore, the propeller body preferably has a Vickers hardness of no less than about 60 Hv and no more than about 95 Hv. If the hardness of the propeller body is smaller than about 60 Hv, the entire propeller 27 will not have sufficient mechanical strength. If the hardness of the propeller body is greater than about 95 Hv, the blade 61 may be chipped upon collision against a foreign object. If the blade 61 is chipped or deformed, the propulsion power of the outboard motor 52 will be considerably lowered. Note that the outer peripheral ends of the blades, except for the edge portions, have a thickness of about 1.0 mm to about 4.0 mm.

The propeller body is composed of an aluminum alloy. In order to reduce the production cost, and enhance the bonding strength between the blades 61 and the hub portion 62, it is preferable to use casting to integrally mold the propeller 27 into shape, and it is more preferable to mold the propeller 27 by die casting technique. Therefore, preferably the propeller body is molded from an aluminum alloy having a composition that facilitates molding by die casting technique.

Specifically, the aluminum alloy is preferably an Al—Mg alloy containing about 1.5 wt % or less of silicon. As the silicon content within the aluminum alloy increases, the melt flow during casting will improve, thus facilitating casting by die casting technique. However, once the silicon content becomes greater than about 1.5 wt %, the aluminum alloy will become hard and brittle, thus resulting in the Vickers hardness of the propeller body being greater than about 95 Hv. This will make it impossible to obtain appropriate ductility.

More preferably, the aluminum alloy further contains no less than about 0.5 wt % and no more than about 1.8 wt % of at least one of iron and manganese. When at least one of iron and manganese is contained at the aforementioned rate, it is possible to obtain an improved releasability from the mold in die casting molding, thus preventing burning onto the mold.

For example, an Al—Mg alloy having a composition such as Al-4Mg-0.8Fe-0.4Mn, Al-5Mg-1.3Si-0.8Fe-0.8Mn, Al-4.5Mg-1.1Fe-0.7Mn, or Al-6.5Mg-1.1Fe-0.7Mn can be used.

The main reason why the silicon content is limited as described above is in order to ensure that the Vickers hardness Hv of the propeller body will not become too high. Therefore, in the case where the Vickers hardness Hv of the propeller body is reduced by a heat treatment such as annealing, it would be possible to increase the silicon content to facilitate casting by die casting technique. Specifically, the propeller body may be composed of an Al—Si alloy, and an annealing treatment may be performed after a molding by die casting technique.

For example, an Al—Si alloy having a composition such as Al-10Si-0.4Mg-0.5Mn or Al-9Si-0.7Fe-0.5Mn can be used. In this case, annealing may be performed under the following conditions, for example: heating at 350° C. is performed for 1.5 hours; and then an air cooling is performed. As a result of this, even if the propeller body has a hardness of about 106 Hv after the casting by die casting technique, the hardness can be lowered to about 65 Hv.

Figure 5:
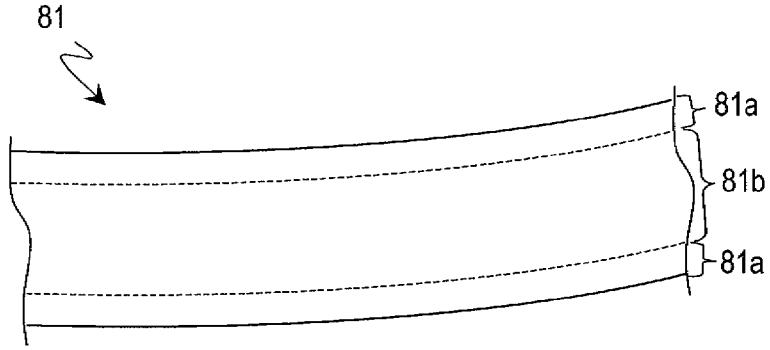
FIG. 5 is a cross-sectional view for explaining how an anodic oxide coating may be generated through anodic oxidation of a propeller body.

The anodic oxide coating of an aluminum alloy covering the surface of the propeller body is preferably formed by subjecting the surface of the propeller body to anodic oxidation. FIG. 5 shows a partial cross section of the blade body 81 before an anodic oxide coating is formed thereon. By subjecting the blade body 81 to anodic oxidation, surface regions 81*a* will be oxidized, thus becoming an anodic oxide coating 61*c* that is composed of aluminum oxide. On the other hand, the remaining portion 81*b* interposed between surface regions 81*a* becomes the blade body 61*b*.

Generally speaking, an anodic oxide coating of an aluminum alloy has a high hardness. Therefore, the propeller 27 having the anodic oxide coating formed thereon acquires a high abrasion resistance. More preferably, the anodic oxide coating has a hardness of no less than about 300 Hv and no more than about 450 Hv. If the hardness of the anodic oxide coating is smaller than about 300 Hv, a sufficiently high abrasion resistance cannot be obtained, and the ductility will also be poor. On the other hand, the hardness of the anodic oxide coating should preferably be as high as possible. However, in order to obtain an anodic oxide coating having a hardness of about 450 Hv, it will become necessary to use special treatment liquids, which will increase the production cost of the anodic oxide coating.

The anodic oxide coating preferably has a thickness of no less than about 20 μm and no more than about 100 μm. If the thickness of the anodic oxide coating is smaller than about 20 μm, adequate abrasion resistance and deformation resistance characteristics will not be obtained. As the anodic oxide coating becomes thicker, the abrasion resistance will improve, but more time will be required for forming the anodic oxide coating, thus resulting in a poorer producibility. In practice, the propeller 27 will exhibit a better abrasion resistance than that of a conventional propeller when the anodic oxide coating has a thickness of about 100 μm.

The hardness of the anodic oxide coating can be adjusted by changing the concentration and temperature of an electrolytic bath which is used for the anodic oxidation. The thickness of the anodic oxide coating can be adjusted based on the length of time of anodic oxidation. As a method of anodic oxidation treatment for forming the anodic oxide coating, it is preferable to use a treatment method which allows a hard anodic oxide coating to be formed, and an electrolyte such as sulfuric acid or oxalic acid can be used.

Figure 6:
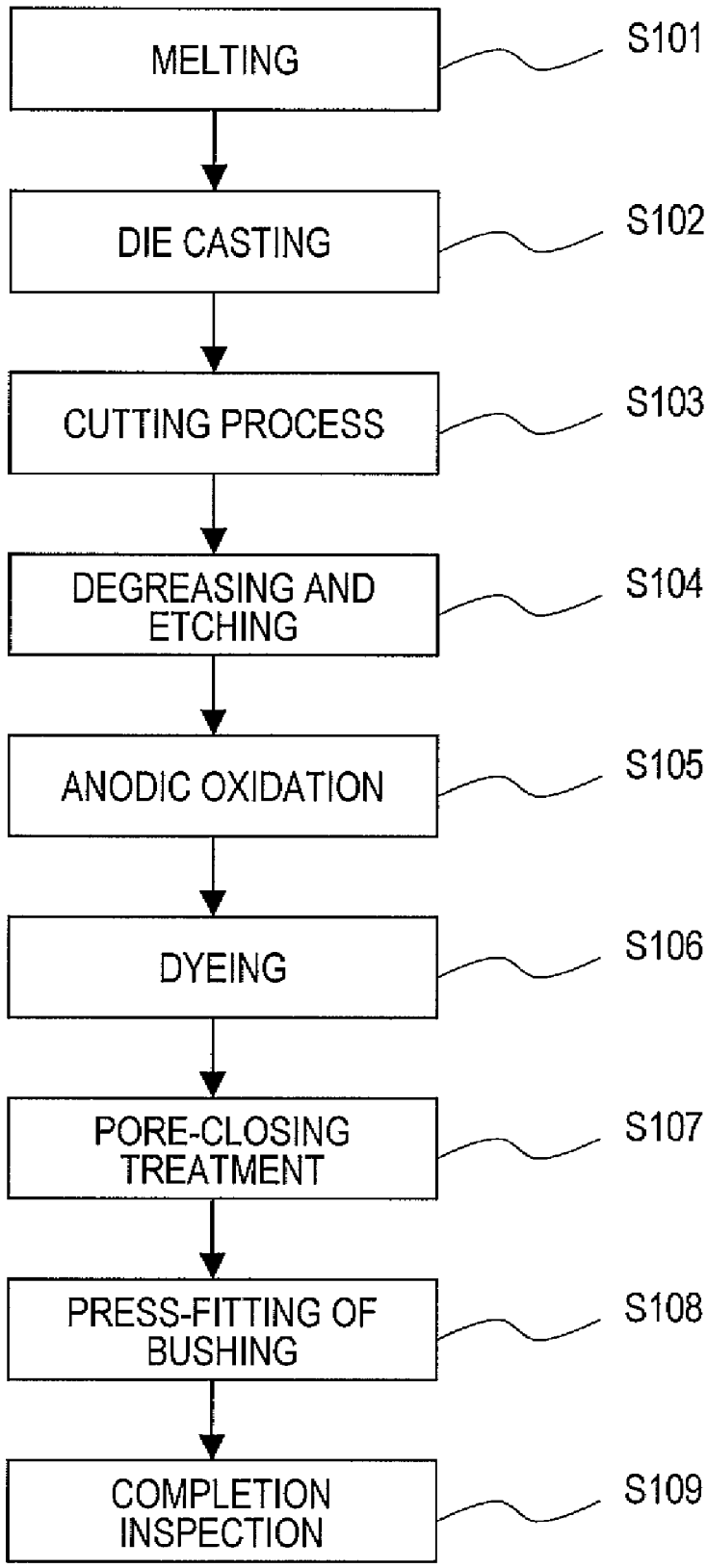
FIG. 6 is a flowchart showing production steps for the propeller shown in FIG. 3.

A propeller according to a preferred embodiment of the present invention can be produced by the following procedure, for example. As shown in FIG. 6, an aluminum alloy having a composition of Al-4Mg-0.8Fe-0.4Mn, for example, is melted (step S101), and the melt is injected into a mold of the shape shown in FIG. 3 according to die casting technique (step S102). After cooling, the gate for melt injection is cut off from the propeller body which has been taken out of the mold, and a cutting process is performed (e.g., adjustment of thickness and shape of the blades) so that the propeller body will take a predetermined shape (step S103). Moreover, any oxide film that has been generated on the surface is removed.

Next, after cleaning the propeller surface by degreasing and etching the propeller body surface (step S104), an anodic oxidation is performed (step S105). For example, by using a 17% sulfuric acid bath and using the propeller body as an anode, an oxidation is performed for 30 minutes with a constant current of 4 A/dm$^2$, while maintaining a bath temperature of 4° C. As a result, an anodic oxide coating having a thickness of 40 μm and a hardness of 400 Hv is obtained.

Next, dyeing may be performed as necessary (step S106). The dyeing can be performed through coloration by dyestuff, electric field coloration, or the like, which takes place by allowing a dyestuff or metal oxide to deposit within the micropores in the anodic oxide coating. Thereafter, a pore-closing treatment is performed for the micropores in order to prevent decolorization and insufficiencies in anti-corrosiveness (step S107).

Thereafter, a bushing is press-fitted into the hub of the propeller (S108), and a completion inspection (S109) is performed, whereby propeller is completed.

Since the propeller body has moderate elastic deformation characteristics, and the surface of the propeller 27 is covered with an anodic oxide coating having a high hardness, the propeller 27 having the above structure will not undergo chipping of the blades or plastic deformation even when colliding against driftwood or the like, so that deterioration of the propulsion power can be prevented. Also, any shift in the center of gravity of the propeller, as caused by deformation or chipping of the propeller, would induce abnormal vibrations when the propeller is rotated, thus unfavorably affecting the outboard motor itself (e.g., the engine and/or the clutch mechanism); this problem is also prevented. Furthermore, since the propeller surface is covered by an anodic oxide coating having a high hardness, excellent abrasion resistance is obtained. In particular, abrasion of the propeller surface can be prevented even in water which is mixed with sand or the like.

Therefore, a boat having the outboard motor according to a preferred embodiment of the present invention is unlikely to undergo deformation or chipping of the propeller even when colliding against driftwood, and abrasion of the propeller is prevented even when traveling over a sandy shallow. Therefore, when used at inshore locations and on rivers, for purposes such as fishery, business operations, and leisure activities, a boat having the outboard motor according to a preferred embodiment of the present invention will exhibit excellent durability, thus being economical.

EXPERIMENTAL EXAMPLES

In order to confirm the effects of various preferred embodiments of the present invention, an anodic oxide coating was formed on the surface of each of propeller bodies molded from aluminum alloys of three compositions, and their physical properties and the like were examined. For comparison, samples were also produced in which a coating of paint or plating was provided on a propeller body, and their characteristics were subjected to comparison. The results are shown in Table 1 below.

As aluminum alloys, aluminum alloys of the following compositions were prepared, from which propeller bodies were molded by die casting technique: Al-4Mg-0.8Fe-0.4Mn (hereinafter "composition A"); Al-10Si-0.4Mg-0.5Mn (hereinafter "composition B"); and Al-4.5Mg-0.7Fe-0.4Mn (hereinafter "composition C").

Samples 1 to 13 having composition A, Samples 14 to 16 having composition B, and Samples 18 and 19 having composition C were not subjected to any heat treatment. Sample 17 having composition B was subjected to annealing.

Anodic oxide coatings of different thicknesses and hardnesses were formed on Samples 2 to 10 of propeller bodies having composition A, Samples 15 to 17 of propeller bodies having composition B, and Samples 18 and 19 of propeller bodies having composition C.

For comparison, a paint coating was formed on Samples 1 and 14, whereas a nickel-phosphorus plating coating was formed on Samples 11 to 13.

The characteristics of the Samples produced were evaluated as follows.

Exterior Appearance

At a position of about 300 mm away from the sample surface, acceptability of the exterior appearance was determined by visual inspection under diffused daylight. Symbols "○", "Δ", and "X" represent, respectively, "uniform", "partly non-uniform", and "non-uniform" exterior appearances.

Anti-Corrosiveness

Each sample was immersed in 5% saline water at room temperature for 100 hours, and its acceptability was determined based on exterior appearance. "○" indicates absence of corrosion; "Δ" indicates partial corrosion; and "X" indicates overall corrosion.

Abrasion Resistance Characteristics

A sand-dropping abrasion test as defined under JIS H8501 was performed for a certain period of time, and acceptability was determined based on exterior appearance. "○" indicates that the propeller body (base) is not exposed; and "X" indicates that the propeller body is exposed.

Deformation Resistance Characteristics 1

Each sample was attached to an outboard motor having 40 horsepower, and a piece of rosewood was allowed to continually collide against the propeller (revolutions: 3000 rpm) during a certain period of time, and the blade deformation was examined. "○" indicates absence of blade deformation, whereas "X" indicates that some blade deformation was observed.

Deformation Resistance Characteristic 2

Each sample was fixed, and a static load was increasingly applied to the blades. Acceptability was determined based on the maximum load value until the moment of cracking and the amount of deformation. "○" indicates that the load value and the amount of deformation are equal to or greater than predefined values, whereas "X" indicates that such values are less than the predefined values.

Determination

With respect to evaluations of characteristics other than exterior appearance, any sample that has one more evaluation items being rated as "X" is determined as "X".

TABLE 1

| | propeller body | | | coating | | | characteristics | | | | | |
|---|---|---|---|---|---|---|---|---|---|---|---|---|
| Sample No. | alloy composition | heat treatment | hardness (Hv) | type | thickness (μm) | hardness (Hv) | exterior appearance | anti-corrosiveness | abrasion resistance characteristics | deformation resistance characteristics 1 | deformation resistance characteristics 2 | determination |
| 1 | A | No | 82 | painting | 40 | — | ○ | ○ | X | X | ○ | X |
| 2 | A | No | 82 | anodic oxide coating | 20 | 230 | ○ | ○ | X | X | ○ | X |
| 3 | A | No | 82 | anodic oxide coating | 20 | 300 | ○ | ○ | ○ | ○ | ○ | ○ |
| 4 | A | No | 82 | anodic oxide coating | 30 | 340 | ○ | ○ | ○ | ○ | ○ | ○ |
| 5 | A | No | 82 | anodic oxide coating | 20 | 370 | ○ | ○ | ○ | ○ | ○ | ○ |
| 6 | A | No | 82 | anodic oxide coating | 20 | 410 | ○ | ○ | ○ | ○ | ○ | ○ |
| 7 | A | No | 82 | anodic oxide coating | 20 | 450 | ○ | ○ | ○ | ○ | ○ | ○ |

TABLE 1-continued

| | propeller body | | | coating | | | characteristics | | | | | |
|---|---|---|---|---|---|---|---|---|---|---|---|---|
| Sample No. | alloy composition | heat treatment | hardness (Hv) | type | thickness (μm) | hardness (Hv) | exterior appearance | anti-corrosiveness | abrasion resistance characteristics | deformation resistance characteristics 1 | deformation resistance characteristics 2 | determination |
| 8 | A | No | 82 | anodic oxide coating | 40 | 410 | ○ | ○ | ○ | ○ | ○ | ○ |
| 9 | A | No | 82 | anodic oxide coating | 60 | 410 | ○ | ○ | ○ | ○ | ○ | ○ |
| 10 | A | No | 82 | anodic oxide coating | 90 | 400 | ○ | ○ | ○ | ○ | ○ | ○ |
| 11 | A | No | 82 | Ni—P plating | 20 | 700 | ○ | X | ○ | ○ | ○ | X |
| 12 | A | No | 82 | Ni—P plating | 40 | 700 | ○ | X | ○ | ○ | ○ | X |
| 13 | A | No | 82 | electro-less Ni—P plating | 20 | 650 | ○ | X | ○ | ○ | ○ | X |
| 14 | B | No | 102 | painting | 40 | — | ○ | ○ | X | X | X | X |
| 15 | B | No | 102 | anodic oxide coating | 15 | 200 | Δ | Δ | X | X | X | X |
| 16 | B | No | 102 | anodic oxide coating | 20 | 370 | Δ | ○ | ○ | ○ | X | X |
| 17 | B | Yes | 62 | anodic oxide coating | 20 | 370 | Δ | ○ | ○ | ○ | ○ | ○ |
| 18 | C | No | 95 | anodic oxide coating | 20 | 440 | ○ | ○ | ○ | ○ | ○ | ○ |
| 19 | C | No | 95 | anodic oxide coating | 40 | 410 | ○ | ○ | ○ | ○ | ○ | ○ |

composition A: Al—4Mg—0.8Fe—0.4Mn
composition B: Al—10Si—0.4Mg—0.5Mn
composition C: Al—4.5Mg—0.7Fe—0.4Mn As shown in Table 1, Samples 1 to 14, 18, and 19 all have a good exterior appearance, whereas Samples 15 to 17 have a partly non-uniform exterior appearance. This is presumably because, since the composition of Samples 15 to 17 contains a large amount of silicon, a large amount of silicon deposit is observed in portions where the melt cools down rapidly during molding by die casting, thus resulting in the non-uniform film thickness and composition of the anodic oxide coating. As far as exterior appearance is concerned, however, no samples have such poor exterior appearance that their aesthetics are degraded, although some samples have inferior uniformity.

As for anti-corrosiveness, it was found that an anodic oxide coating provides sufficient anti-corrosiveness with a film thickness of about 20 μm or more. It was further found that the samples having a paint coating also have sufficient anti-corrosiveness. On the other hand, coatings of nickel-phosphorus plating formed by electroplating and electroless plating do not provide sufficient anti-corrosiveness.

As for abrasion resistance characteristics, as can be seen from Samples 1 and 14, paint coatings do not provide sufficient abrasion resistance characteristics. Moreover, among the samples having an anodic oxide coating, Samples 2 and 15 have inferior abrasion resistance characteristics. This is presumably because the thickness of the anodic oxide coating is about 20 μm or less and the hardness of the anodic oxide coating is smaller than about 300 Hv. From the results of Sample 3, it can be seen that sufficient abrasion resistance characteristics are obtained when there is a hardness of about 300 Hv, even if the anodic oxide coating is about 20 μm.

As for deformation resistance characteristics 1, Samples 1, 2, 14, and 15 do not exhibit sufficient elastic deformation in a collision against wood. It is considered that, since paint coatings and anodic oxide coatings having a thickness less than about 20 μm and a hardness less than about 300 Hv do not have a sufficient mechanical strength at the surface, the blades may be deformed through collision with driftwood or the like, even if the propeller body has a high ductility.

Deformation resistance characteristics 2 represent the ductility of the propeller body. As can be seen from Samples 18 and 19, the propeller bodies have a sufficient ductility even with a hardness of about 95 Hv. However, Samples 14, 15, and 16 do not have enough ductility because the propeller bodies have a hardness of about 102 Hv. This is presumably because the aluminum alloy composing the propeller bodies of Samples 14, 15, and 16 contains a large amount of silicon, thus being hard and brittle. On the other hand, as can be seen from the results of Sample 17, even among propellers that are composed of an aluminum alloy of the same composition, the hardness of each propeller body can be lowered by annealing, until sufficient deformation characteristics are exhibited. This is the presumable reason for the high deformation resistance characteristics 2 rating of Sample 17. In other words, the relatively soft propeller body and the thicker-than-usual hard anodic oxide coating allow for improved deformation resistance characteristics 2.

From these results, it can be seen that Samples 3 to 10 and Samples 17 to 19, in which the propeller body has a Vickers hardness of no less than about 60 Hv and no more than about 95 Hv, and in which an anodic oxide coating having a thickness of no less than about 20 μm and no more than about 100 μm as well as a hardness of no less than about 300 Hv and no more than about 450 Hv is formed on the surface, are excellent in terms of abrasion resistance and deformation resistance characteristics, and are suitable as durable propellers for outboard motors.

The propeller for watercraft and outboard motor according to preferred embodiments of the present invention is suitably used for various kinds of boats, and is particularly suitably used for small-sized boats intended for various purposes, e.g., fishery, business operations, or leisure activities.

While the present invention has been described with respect to preferred embodiments thereof, it will be apparent to those skilled in the art that the disclosed invention may be modified in numerous ways and may assume many embodiments other than those specifically described above. Accordingly, it is intended by the appended claims to cover all modifications of the invention that fall within the true spirit and scope of the invention.

This application is based on Japanese Patent Applications No. 2006-226351 filed on Aug. 23, 2006 and No. 2007-210917 filed Aug. 13, 2007, the entire contents of which are hereby incorporated by reference.

What is claimed is:

1. A propeller for watercraft, comprising:

a propeller body having a blade and a hub portion, the propeller body being composed of an aluminum alloy and having a Vickers hardness of no less than about 60 Hv and no more than about 95 Hv; and an anodic oxide coating of the aluminum alloy arranged so as to cover a surface of the propeller body; wherein the anodic oxide coating has a thickness of no less than about 20 μm and no more than about 100 μm; wherein the anodic oxide coating has a hardness of no less than about 300 Hv and no more than about 450 Hv.

2. The propeller for watercraft of claim 1, wherein the propeller body made of the aluminum alloy is die cast molded.

3. The propeller for watercraft of claim 2, wherein the aluminum alloy is an Al—Mg alloy containing about 1.5 wt % or less of silicon.

4. The propeller for watercraft of claim 3, wherein the Al—Mg alloy further contains no less than about 0.5 wt % and no more than about 1.8 wt % of at least one of iron and manganese.

5. The propeller for watercraft of claim 2, wherein the aluminum alloy is an annealed Al—Si alloy.

6. An outboard motor comprising the propeller for watercraft of claim 1.

7. A boat comprising the outboard motor of claim 6.

* * * * *